United States Patent [19]

Zedrosser

[11] Patent Number: 4,916,844

[45] Date of Patent: Apr. 17, 1990

[54] HAND-HELD FIREARM

[75] Inventor: Ulrich Zedrosser, Steyr, Austria

[73] Assignee: Steyr-Daimler-Puch AG, Vienna, Austria

[21] Appl. No.: 404,103

[22] Filed: Sep. 7, 1989

[30] Foreign Application Priority Data

Sep. 23, 1988 [AT] Austria ..... A2350/88

[51] Int. Cl.[4] ..... F41C 17/00; F41C 21/22

[52] U.S. Cl. ..... 42/75.02; 42/70.02

[58] Field of Search ..... 42/70.01, 75.02

[56] References Cited

U.S. PATENT DOCUMENTS 2,981,154 4/1961 Sweeney .

FOREIGN PATENT DOCUMENTS 432028 7/1926 Fed. Rep. of Germany .

*Primary Examiner*—Charles T. Jordan
*Assistant Examiner*—Richard W. Wendtland
*Attorney, Agent, or Firm*—Marmorek, Guttman & Rubenstein

[57] ABSTRACT

A hand-held firearm comprises a receiver, a barrel, which is detachably mounted in said receiver, a firing mechanism and a slider, which during the loading and/or firing operation cooperates with the firing mechanism and is mounted in said receiver for a movement in the longitudinal direction of said barrel against the force of a return spring, wherein the barrel is detachably mounted in a locking sleeve, which is fixed to the housing, the barrel has been locked in said sleeve by a rotary movement. Said housing is provided with a barrel bearing, a bushing is mounted in said barrel holder in front of the forward end of the path for said slider, and said barrel extends through said bushing. In order to ensure that an inadvertent discharge of a round will reliably be prevented when the barrel has been detached or has not properly been locked, the bushing contains two mutually associated insert sleeves, which slidably contact each other by means of helical guiding edges and comprise a forward actuating sleeve, which is rotatably and axially immovably mounted in the bushing, and a rear restraining sleeve, which is mounted in the bushing to be axially displaceable and non-rotatable. The actuating sleeve is formed with at least one forwardly open, axial groove for receiving a coupling nose of the barrel. The restraining sleeve is adapted to be rearwardly displaced from the bushing into the path for the slider when the actuating sleeve has been rotated to the angular extent of the rotation of the barrel from its locked position to its unlocked position.

3 Claims, 1 Drawing Sheet

HAND-HELD FIREARM

BACKGROUND OF THE INVENTION

1. Field of the Invention

This invention relates to a hand-held firearm, particularly to a rifle, comprising a receiver, a barrel, which is detachably mounted in said receiver, a firing mechanism and a slider, which during the loading and/or firing operation cooperates with the firing mechanism and is mounted in said receiver for a movement in the longitudinal direction of said barrel against the force of a return spring, wherein the barrel is detachably mounted in a locking sleeve, which is fixed to the housing, the barrel has been locked in said sleeve by a rotary movement, said housing is provided with a barrel bearing, a bushing is mounted in said barrel bearing in front of the forward end of the path for said slider, and said barrel extends through said bushing.

2. Description of the Prior Art

Firearms having a detachably mounted barrel and a chamber member which is separate from the barrel and included in the firing mechanism will permit the use of a simpler firing mechanism, will facilitate the care of the firearm and the use of different barrels, and will permit a shortening of the required overall length. On the other hand, the fact that the barrel is detachable involves the risk that a round may inadvertently be discharged when the barrel has not properly been locked or has even been removed. This is due to the fact that the sequences of motions performed by the firing mechanism, which is provided in most cases with a spring drive, and by the slider, which in automatic firearms is often included in the gas-actuated drive, will depend on each other but the barrel is not required to perform an essential function for the loading of the firearm and the discharge of the round.

For instance, German Patent Specification 432,028 discloses a firearm that is provided with an insert barrel, which is secured by means of a locking sleeve that is adapted to be mounted on the mouth of the barrel by a bayonet joint and into which the insert barrel is adapted to be screwed by means of a liner sleeve, which is provided with external and internal screw threads and permits the insert barrel to be inserted to a desired depth and to be arranged in a desired angular position whereas the firing and loading operations of the firearm cannot be influenced.

SUMMARY OF THE INVENTION

For this reason it is an object of the invention to eliminate that disadvantage and to provide a hand-held firearm which is of the kind described first hereinbefore and which owing to the provision of relatively simple means permits a simple handling of the firearm and permits a discharge of a round only when the barrel has properly been inserted and also facilitates the replacement of the barrel.

That object is accomplished in accordance with the invention in that the bushing contains two mutually associated insert sleeves, which slidably contact each other by means of helical guiding edges and comprise a forward actuating sleeve, which is rotatably and axially immovably mounted in the bushing, and a rear restraining sleeve, which is mounted in the bushing to be axially displaceable and non-rotatable, the actuating sleeve is formed with at least one forwardly open, axial groove for receiving a coupling nose of the barrel, and the restraining sleeve is adapted to be rearwardly displaced from the bushing into the path for the slider when the actuating sleeve has been rotated to the angular extent of the rotation of the barrel from its locked position to its unlocked position.

In that arrangement, a rotation of the actuating sleeve to the angular extent of the rotation of the barrel from its locked position to its unlocked position will have the result that owing to the sliding contact between the helical guiding edges the actuating sleeve will move the restraining sleeve rearwardly out of the bushing and possibly to urge the slider out of its forward end position against the force of the return spring. As a result, the restraining sleeve then constitutes a rearwardly displaced end stop for the slider, which will then be prevented from performing its proper forward displacement so that the proper loading and firing operations of the firing mechanism will also be prevented. For this reason the fact that the barrel has been removed or has not properly been locked will cause the restraining sleeve to be rearwardly extended to interrupt the movement of the slider so that another round cannot be discharged. As soon as the barrel has properly been inserted and locked, the actuating sleeve will perform a reverse rotation so that the restraining sleeve is no longer restrained by the helical guiding edges and under a load which is applied, e.g., by the advancing slider, can assume its forward position in the bushing. The movement of the slider will then no longer be interrupted by an end stop and the hand-held firearm will then be in an operative condition.

In a particularly desirable embodiment of the invention the actuating sleeve and the restraining sleeve constitute stops for limiting their relative rotation to the angular extent of the rotation that is required to lock the barrel. In that case said stops will not only prevent an excessive angular movement of the actuating sleeve but owing to the required axial alignment of the coupling noses of the rotated barrel and the axial grooves of the actuating sleeve will define two angular positions also for the barrel, namely an unlocked position and a locked position. As a result, it will be sufficient to rotate the barrel, in the unlocking and locking senses until respective stops become effective and the barrel can satisfactorily be removed and inserted.

DETAILED DESCRIPTION OF THE PREFERRED EMBODIMENT

Figures 1, 2:
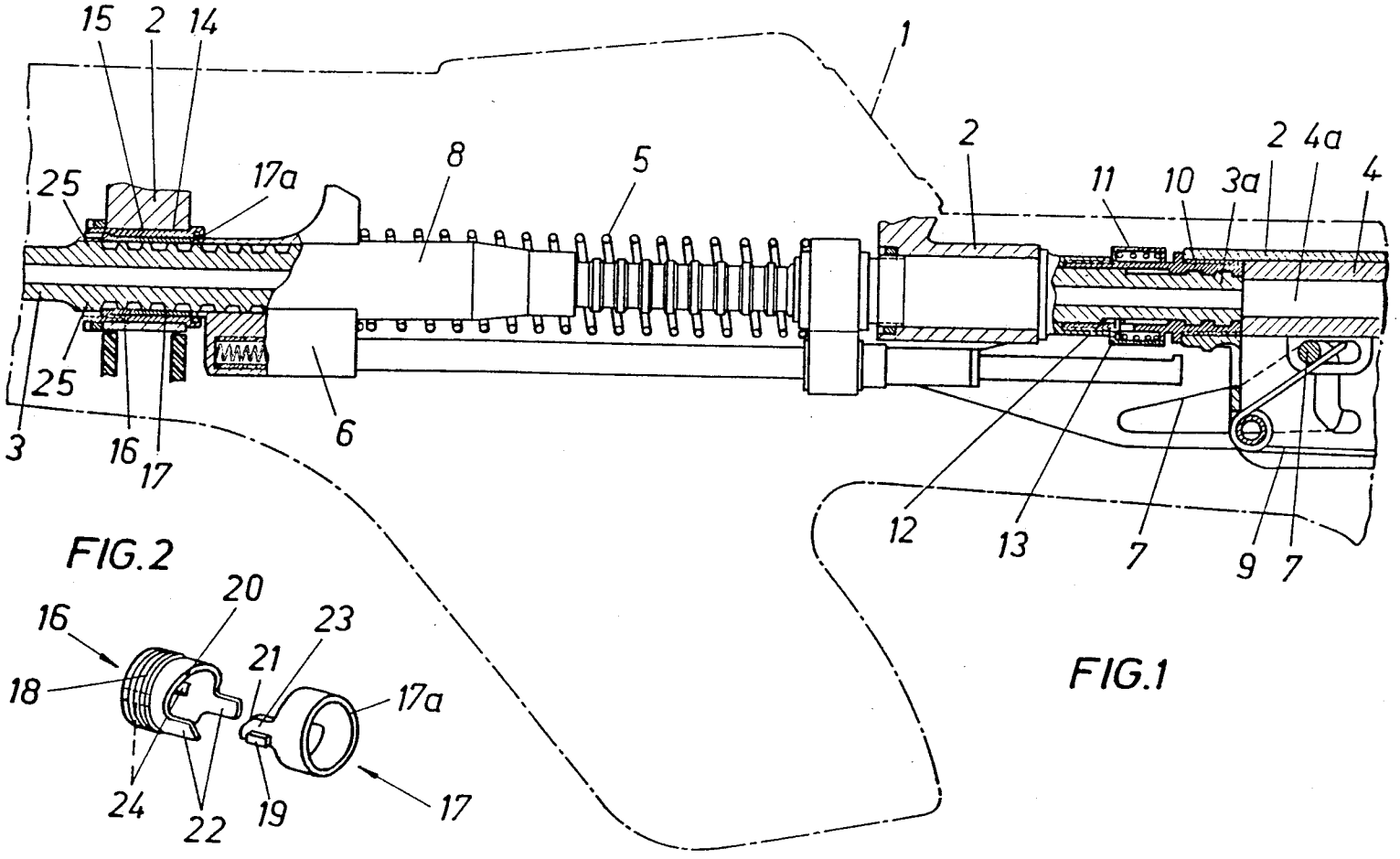
FIG. 1 is a fragmentary side elevations showing partly in section a portion of a handheld firearm in accordance with the invention.
FIG. 2 is a perspective view showing the restraining and actuating sleeves of that firearm.

A rifle 1 comprises a receiver 2, a barrel 3, which is detachably mounted in the receiver, and a firing mechanism, which includes a transversely movable chamber member 4 and a slider 6, which is mounted in the receiver 2 for a sliding movement in the longitudinal direction of the barrel 3 against the force of a return spring 5. The chamber member 4 is separate from the barrel 3 and defines a chamber 4a. During the loading and firing operations the chamber member 4 cooperates with the slider 6, e.g., by means of a cam mechanism 7, which is only diagrammatically indicated. The slider 6 comprises a gas cylinder 8, which surrounds the barrel 3 and is also only diagrammatically indicated. After the discharge of each round, the slider 6 is moved to the rear by the powder gases, which enter from the barrel 3 into the gas cylinder 8. During its rearward movement, the slider 6 by means of the cam mechanism 7 moves the chamber member 4 from its firing position to its loading position. The chamber member 4 has been moved from its loading position to its firing position by a spring drive 9, which has been released by the trigger.

The barrel 3 has a rear end portion 3a, which has been inserted into a locking sleeve 10, which is fixed to the receiver 1 and in which the barrel 3 has been rotated to a locked position. A spring-loaded retaining liner 11 has a locking pin 13, which extends into an axial groove 12 of the barrel and in the locked position of the barrel 3 prevents an undesired rotation of the barrel 3. The retaining liner 11 can be axially pushed back to move the locking pin 13 out of the groove 12 of the barrel so that the barrel 3 can then be rotated to its unlocked position.

The barrel 3 is additionally supported in the receiver by means of a barrel bearing 14, which is provided in front of the forward end of the path for the slider. A bushing 15 is fitted in said barrel bearing 14 and contains two mutually associated insert sleeves 16, 17, namely, a forward actuating sleeve 16 and a rear restraining sleeve 17. By means of guide rings or screw threads 18 the actuating sleeve 16 is rotatably mounted and axially fixed in the bushing 15. By means of guide ribs 19 the restraining sleeve 17 is non-rotatably and axially slidably mounted in the bushing 15. Owing to their helical guiding edges 20, 21, which are in sliding contact with each other, the two sleeves 16, 17 are axially coupled to each other in one direction like parts which have meshing screw threads. The two sleeves 16, 17 also constitute stops 22, 23 for limiting the relative rotation of the actuating sleeve 16 and the restraining sleeve 17 to the angular extent of the rotation that must be imparted to the barrel 3 to move it between its locked and unlocked positions. The actuating sleeve 16 comprises two forwardly open axial grooves 24, which receive coupled noses 25 of the barrel 3 so that a rotation of the inserted barrel 3 will positively effect a rotation of the actuating sleeve 16. Owing to the screw threads by which the actuating sleeve 16 and the restraining sleeve 17 are coupled to each other, the rotation imparted to the actuating sleeve 16 by the unlocking rotation of the barrel 3 will impart a rearward axial movement of the actuating sleeve 17 and the dimensions are so selected that the restraining sleeve 17 is rearwardly extended to the rear until it protrudes into the path for the slider and the end face 17*a* of the restraining sleeve 17 constitutes a stop, which reduces the length of the path for the slider 6. Because the movement of the slider 6 is thus prematurely interrupted, the chamber member 4 cannot move to its firing position so that a discharge of a round need no longer be feared. Upon a rotation of the barrel 3 in an unlocking sense the actuating sleeve 17 will thus positively activate the restraining sleeve 17 to constitute a stop, which limits the movement of the slider so that a round cannot be discharged when the barrel 3 has been unlocked or detached. By a rotation of the barrel 3 to its locked position, a reverse rotation is imparted to the actuating sleeve 16 so that the restraining sleeve 17 is now axially movable and can be pushed forwardly to a sufficient extent by the slider 6 as it moves forwardly. The path for the slider has thus been cleared and the firearm 1 is perfectly operable.

I claim:

1. In a hand-held firearm comprising a receiver defining a slider path having a forward end, a barrel having a rear end portion, which is detachably mounted in said receiver and extends in the same direction as said slider path, a firing mechanism, which is operable to perform loading and firing operations, a slider, which is slidably mounted in said receiver for a movement along said slider path and arranged to cooperate with said firing mechanism during at least part of said loading and firing operations, means operable to impart a rearward movement to said slider along said slider path, a return spring urging said slider forwardly, a locking sleeve, which is fixed to said receiver, said rear end portion of said barrel being detachably mounted in said locking sleeve and being rotatable in said locking sleeve between locked and unlocked positions, said locking sleeve and said rear end portion of said barrel being provided with means arranged to axially lock and unlock said barrel in said locking sleeve when said barrel is in said locking and unlocking positions, respectively, a barrel bearing provided in said receiver, and a bushing mounted in said barrel bearing in front of said forward end of said slider path and surrounding said barrel forwardly of said rear end portion of said barrel, the improvement residing in that said bushing contains an actuating sleeve and a restraining sleeve, which is axially aligned with and extends rearwardly of said actuating sleeve, said actuating sleeve and said restraining sleeve are respectively formed with first and second helical guiding edges in sliding contact with each other, said actuating sleeve is rotatably mounted and axially fixed in said bushing, said restraining sleeve is axially slidably and non-rotatably mounted in said bushing, said actuating sleeve has at least one forwardly open axial groove, said barrel has at least one radially outwardly protruding coupling nose extending into said at least one groove, and the arrangement is such that upon a rotation of said barrel from said locked position to said unlocked position said coupling sleeve will perform a corresponding rotation and owing to the slidable contact between said first and second helical guiding edges will impart to said restraining sleeve a rearward movement out of said bushing into said slider path to limit the forward movement of said slider along said slider path.

2. The improvement set forth in claim 1 as applied to a hand-held firearm which consists of a rifle.

3. The improvement set forth in claim 1, wherein said actuating sleeve and said restraining sleeve are respectively provided with first and second stops, which are interengageable to limit the relative rotation of said actuating and restraining sleeves to the angular extent of the rotation of said barrel between said locked and unlocked positions.

* * * * *